US005768658A

United States Patent [19]

Watanabe et al.

[11] Patent Number: 5,768,658

[45] Date of Patent: Jun. 16, 1998

[54] ELECTRODE MEMBER, DEVELOPING APPARATUS, PROCESS CARTRIDGE AND IMAGE FORMING APPARATUS

[75] Inventors: Kazushi Watanabe; Atsushi Numagami, both of Mishima; Tsutomu Nishiuwatoko, Tokyo; Koji Miura, Mishima; Kazuhiko Kanno, Numazu; Toru Oguma, Susono, all of Japan

[73] Assignee: Canon Kabushiki Kaisha, Tokyo, Japan

[21] Appl. No.: 683,987

[22] Filed: Jul. 19, 1996

[30] Foreign Application Priority Data

Jul. 21, 1995 [JP] Japan ..... 7-206803
Sep. 27, 1995 [JP] Japan ..... 7-249416

[51] Int. Cl.[6] ..... G03G 21/16

[52] U.S. Cl. ..... 399/111; 399/119; 399/90

[58] Field of Search ..... 399/110, 111, 399/119, 90

[56] References Cited

U.S. PATENT DOCUMENTS 5,151,734 9/1992 Tsuda et al. .
5,208,634 5/1993 Ikemoto et al. .
5,223,893 6/1993 Ikemoto et al. .
5,283,616 2/1994 Numagami et al. .
5,283,619 2/1994 Nomura et al. ..... 399/90
5,331,372 7/1994 Tsuda et al. .
5,331,373 7/1994 Nomura et al. .
5,345,294 9/1994 Nomura et al. .
5,404,198 4/1995 Noda et al. .
5,452,056 9/1995 Nomura et al. .
5,463,446 10/1995 Watanabe et al. .
5,465,136 11/1995 Watanabe .
5,470,635 11/1995 Shirai et al. .
5,475,470 12/1995 Sasago et al. .
5,488,459 1/1996 Tsuda et al. .
5,500,714 3/1996 Yashiro et al. .
5,510,878 4/1996 Noda et al. .
5,543,898 8/1996 Shishido et al. .

FOREIGN PATENT DOCUMENTS 06-083180 3/1994 Japan .

*Primary Examiner*—Matthew S. Smith
*Attorney, Agent, or Firm*—Fitzpatrick, Cella, Harper & Scinto

[57] ABSTRACT

The present invention provides a process cartridge removably mounted to an electrophotographic image forming apparatus. It comprises an electrophotographic photosensitive member, a developing sleeve for supplying magnetic toner to the electrophotographic photosensitive member to develop a latent image formed on the electrophotographic photosensitive member, a magnet disposed within the developing sleeve, and an electrode member for supplying electricity from the image forming apparatus to the developing sleeve when the process cartridge is mounted to the image forming apparatus. The magnet is positioned in a thrust direction by the electrode member.

36 Claims, 10 Drawing Sheets

ELECTRODE MEMBER, DEVELOPING APPARATUS, PROCESS CARTRIDGE AND IMAGE FORMING APPARATUS

BACKGROUND OF THE INVENTION

1. Field of the Invention

The present invention relates to a developing device, a process cartridge removably mounted to an image forming apparatus for forming an image on a recording medium, an electrode member used with such a process cartridge, and an image forming apparatus.

2. Description of the Related Art

In image forming apparatuses such as printers, copying machines and the like, a latent image is formed on a photosensitive member by selectively exposing the uniformly charged photosensitive member, which latent image is in turn developed with toner supplied from a toner bearing member as a toner image. Then, the toner image is transferred onto a recording medium to record an image on the recording medium. In an image forming apparatus using such an electrophotographic image forming process, the electrophotographic photosensitive member and process means acting on the electrophotographic photosensitive member are incorporated into a cartridge unit to form a process cartridge which can be removably mounted to the image forming apparatus. By using such a process cartridge, since the maintenance of the apparatus can be performed by the user without any expert and the operability is greatly improved, such a process cartridge is widely used in various image forming apparatuses.

For example, as shown in FIG. 10, in a process cartridge, a charge means 8, an exposure means 9, a developing means 10 and a cleaning means 11 are disposed around an electrophotographic photosensitive member 7, and these elements 7–11 are contained in a housing comprised of a developing frame 12*a* and a cleaning frame 12*b* to form a unit which can be removably mounted to the image forming apparatus. As shown in FIG. 11, the developing means 10 has a developing sleeve (toner bearing member) 10*c* including a magnet roller 10*b* therein, and flanges 10*h* of the developing sleeve 10*c* are rotatably supported by bearing members 10*g* attached to the developing frame 12*a*. The magnet roller 10*b* is supported by side plates 12*c*, 12*d* attached to the developing frame 12*a*. In the vicinity of axial ends 10*b*1 of the magnet roller 10*b*, there are disposed end seal members 10*e* adhered to the developing frame 12*a* and contacted with the developing sleeve 10*c* to prevent the toner from leaking outside.

FIG. 9 is a sectional view of a developing apparatus used as a portion of another process cartridge, which developing apparatus has a developing device for visualizing an electrostatic latent image formed on the photosensitive member with toner (developing agent). A developing roller is disposed within the developing device, and, by the action of a magnetic force of the developing roller, the toner in the developing device is supplied toward the photosensitive drum.

As shown in FIG. 9, the developing roller is constituted by a cylindrical developing sleeve 21 rotated in one direction, and a magnet roller 22 disposed within the developing sleeve 21. Flange portions 24*a*, 24*b* are secured to both ends of the developing sleeve 21 by press-fit, adhesion and the like, and the flange portions 24*a*, 24*b* are supported by a body 23 of the developing device via bearing members 25*a*, 25*b*. Regarding the bias power supply to the developing sleeve 21, a sleeve electrode 26 secured to the flange portion 24*b* is contacted with an inner surface of the developing sleeve 21 and is also contacted with an electrode plate 27 secured to a holder 29*b*. When such a process cartridge is mounted within an image forming apparatus, as shown in FIG. 9, the electrode plate 27 is contacted with a contact 31 of the image forming apparatus, thereby providing the electrical connection.

By the way, the magnet roller 22 disposed within the developing sleeve 21 has magnetic poles disposed along a circumferential direction and oriented at a predetermined angle with respect to a photosensitive drum (not shown) to supply a predetermined amount of toner to the photosensitive drum. Thus, at least one end 22*b* of the magnet roller 22 can be positioned at a predetermined angle. In FIG. 9, the magnet roller has one D-shaped protruded end 22*b* and another cylindrical protruded end 22*a*. The ends 22*a*, 22*b* of the magnet roller 22 are supported by holders 29*a*, 29*b* secured to the body 23 of the developing device, and the angular positioning of the magnet roller 22 is effected by fitting the D-shaped end 22*b* of the magnet roller 22 into a corresponding D-shaped hole formed in the holder 29*b*. During assembly, when the holder 29*b* is secured to the body 23 of the developing device by screws, the holder is assembled to be engaged by the D-shaped end 22*b* of the magnet roller 22 while positioning positioning holes of the holder in place.

However, recently, as copying machines have been made compact, the developing device has also been required to be made compact. But, the structural design limits the compactness. For example, the lateral dimension is defined by a length of the magnet roller 22. Further, since the magnet roller 22 must be positioned between the holders 29*a*, 29*b* for securing both ends of the magnet roller 22, certain clearances S must be reserved.

SUMMARY OF THE INVENTION

An object of the present invention is to provide a developing apparatus, a process cartridge, an image forming apparatus and an electrode member, which can improve attachment position accuracy in a longitudinal direction of a magnet roller.

Another object of the present invention is to provide a developing apparatus, a process cartridge, an image forming apparatus and an electrode member, which can surely prevent axial positional deviation between ends of a magnet roller and end seal members without making the apparatus bulky.

A further object of the present invention is to provide a developing apparatus, a process cartridge, an image forming apparatus and an electrode member, in which a magnet roller is positioned in a thrust direction by the electrode member for supplying electricity to a developing sleeve for bearing toner.

A still further object of the present invention is to provide a developing apparatus, a process cartridge, an image forming apparatus and an electrode member, which can position a magnet disposed within a developing sleeve.

Another object of the present invention is to provide a developing apparatus, a process cartridge, an image forming apparatus and an electrode member, in which a magnet roller disposed within a developing sleeve is positioned in a thrust direction by the electrode member for supplying electricity to the developing sleeve.

BRIEF DESCRIPTION OF THE DRAWINGS

FIG. 11 is an explanatory view showing a conventional process cartridge.

DETAILED DESCRIPTION OF THE PREFERRED EMBODIMENTS

The present invention will now be explained in connection with embodiments thereof with reference to the accompanying drawings.

Incidentally, the following embodiments disclose a process cartridge comprising an electrophotographic photosensitive member, a developing sleeve for supplying magnetic toner to the electrophotographic photosensitive member to develop a latent image formed on the electrophotographic photosensitive member, a magnet disposed within the developing sleeve, and an electrode member for supplying electricity from an image forming apparatus to the developing sleeve when the process cartridge is mounted to the image forming apparatus. Wherein the process cartridge can be removably mounted on the image forming apparatus.

(First Embodiment)

Figure 1:
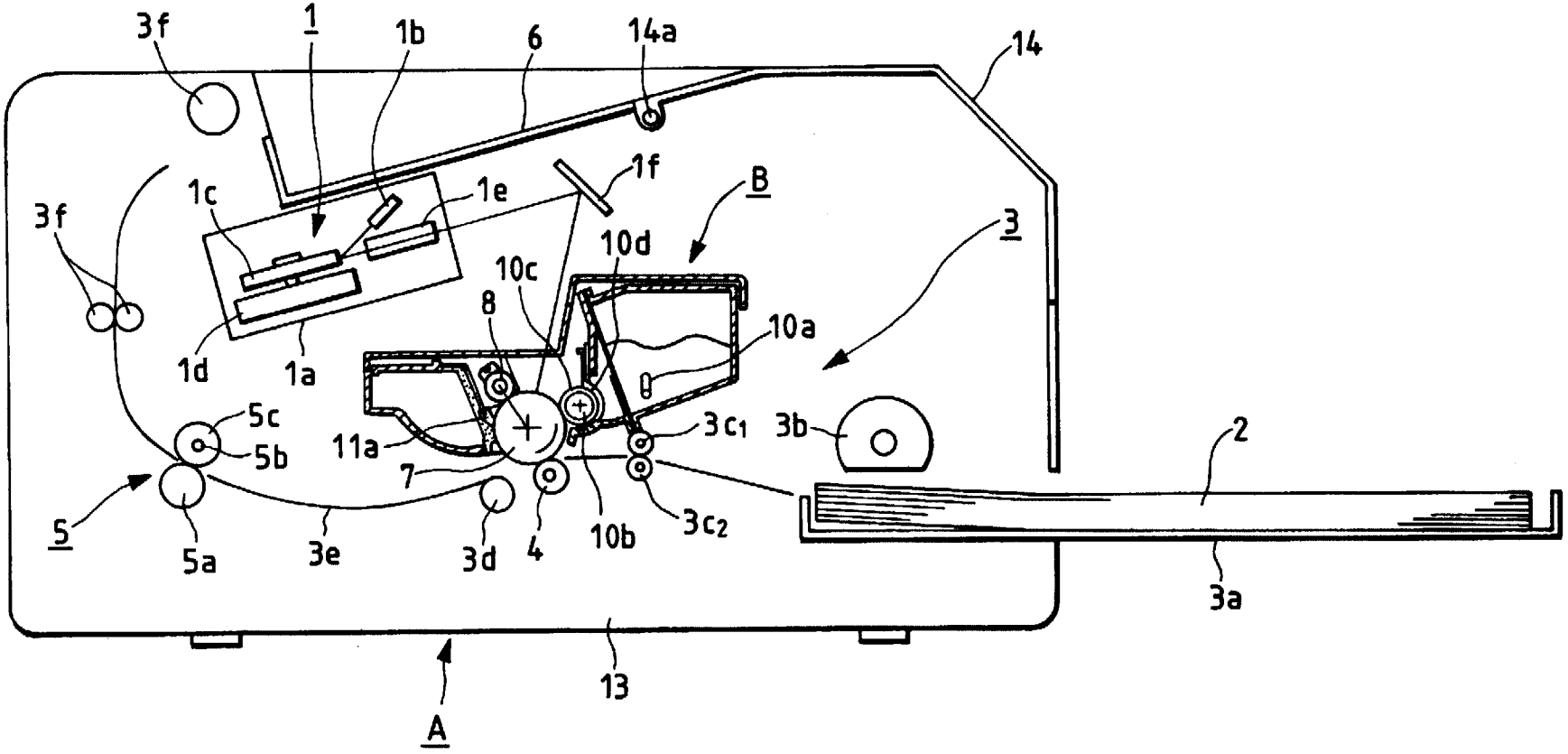
FIG. 1 is an explanatory view for explaining an image forming apparatus according to the present invention.
Figure 2:
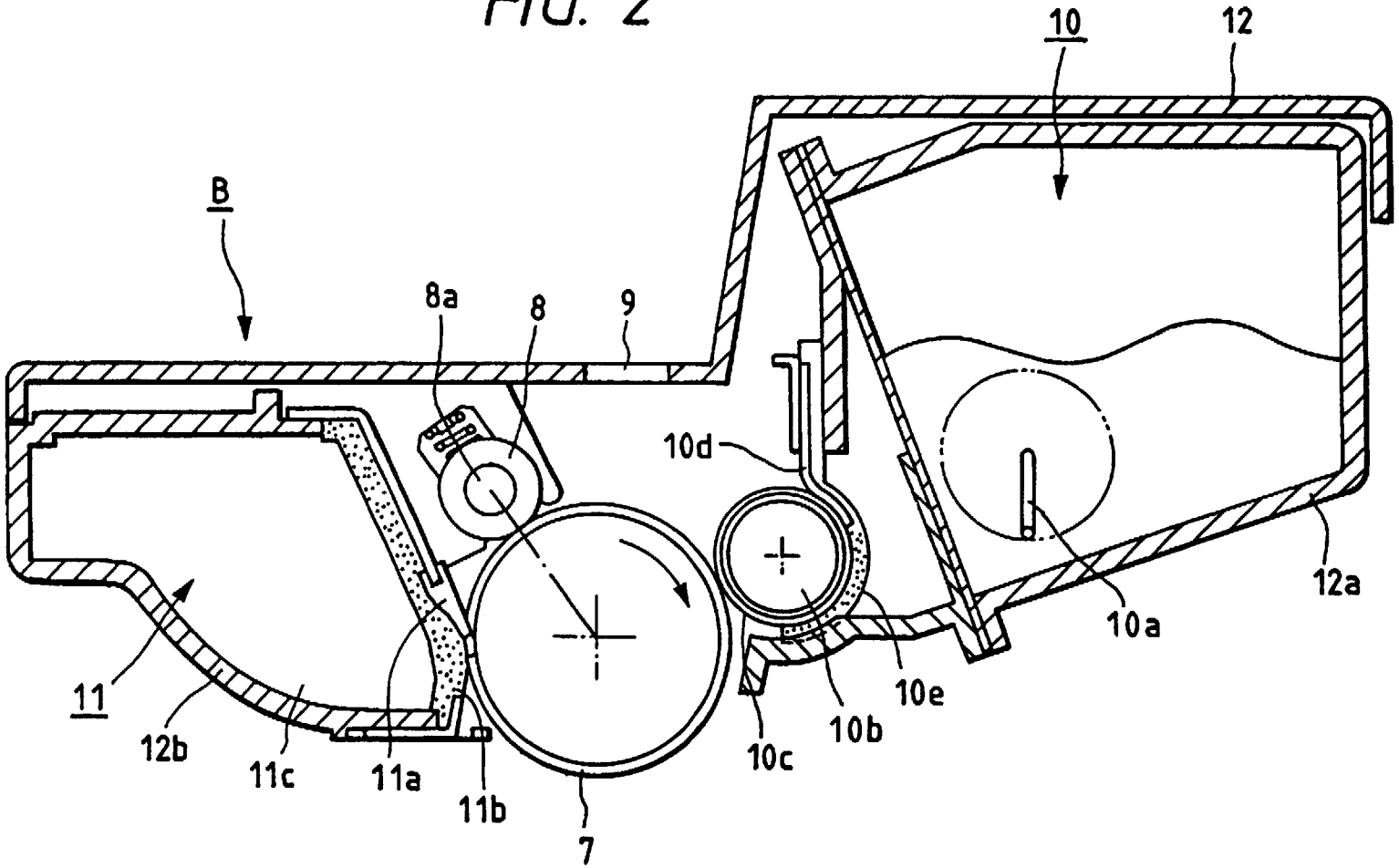
FIG. 2 is a sectional view of a process cartridge according to a first embodiment of the present invention.

First of all, a first embodiment of the present invention will be explained with reference to the accompanying drawings. FIG. 1 is a schematic illustration showing an electrophotographic image forming apparatus to which a process cartridge is mounted, and FIG. 2 is a schematic illustration showing the process cartridge.

First of all, the entire construction of the image forming apparatus to which the process cartridge is mounted will be explained, and then, various elements of the electrophotographic image forming apparatus and the process cartridge will be explained, and, lastly, a developing sleeve of the process cartridge will be explained.

(Entire Construction)

As shown in FIG. 1, in the image forming apparatus A, a toner image is formed on a photosensitive drum 7 by illuminating a light image on the drum in response to image information from an optical system 1. Synchronously with the formation of the toner image, a recording medium 2 is conveyed by a convey means 3, and, in an image forming portion formed as a process cartridge B, the toner image formed on the photosensitive drum 7 is transferred onto the recording medium 2 by a transfer means 4. Then, the recording medium 2 is sent to a fixing means 5, where the transferred toner image is fixed to the recording medium. Thereafter, the recording medium is discharged to a discharge portion 6.

As shown in FIG. 2, in the process cartridge B constituting the image forming portion, the surface of the rotating photosensitive drum 7 is uniformly charged by a charge means 8 to expose the photosensitive drum 7 by the light image from the optical system 1 through an exposure portion 9, thereby forming a latent image. The latent image is developed by a developing means 10 to form a toner image corresponding to the latent image. After the toner image is transferred to the recording medium 2 by the transfer means 4, the residual toner remaining on the photosensitive drum 7 is removed by a cleaning means 11.

Incidentally, various elements such as the photosensitive drum 7 are contained in a toner frame 12*a* and a cleaning frame 12*b* as a cartridge.

{Image Forming Apparatus}

The optical system, convey means, transfer means, fixing means and cartridge mounting means of the image forming apparatus A will now be described in order.

(Optical System)

The optical system 1 serves to illuminate the light image onto the photosensitive drum 7 in response to image information read from an external device, and, as shown in FIG. 1, comprises an optical unit 1*a* including a laser diode 1*b*, a polygon mirror 1*c*, a scanner motor 1*d* and a focusing lens 1*e* and is mounted within a body 13 of the image forming apparatus.

For example, when an image signal is supplied from external equipment such as a computer, word processor and the like, the laser diode 1*b* emits the light in response to the image signal, and the light is illuminated onto the polygon mirror 1*c* as image light. The polygon mirror 1*c* is rotated at a high speed by the scanner motor 1*d* so that the image light reflected by the polygon mirror 1*c* is illuminated onto the rotating photosensitive drum 7 through the focusing lens 1*e* and a reflection mirror 1*f*, thereby selectively exposing the surface of the photosensitive drum 7 to form a latent image corresponding to the image information.

(Recording Medium Convey Means)

The convey means 3 for conveying the recording medium (for example, a recording sheet, an OHP sheet, cloth or a thin plate) 2 has a cassette mounting portion disposed within a body of the apparatus (apparatus body) 13. The recording media 2 contained within a cassette 3*a* are supplied one by one by means of a pick-up roller 3*b* to a pair of regist rollers 3*c*1, 3*c*2. The pair of regist rollers 3*c*1, 3*c*2 conveys the recording medium 2 to an image transferring portion synchronously with the image forming operation. The recording medium 2 to which the image was transferred is conveyed to the fixing means 5 through a convey roller 3*d* and a guide plate 3*e*. After the fixing, the recording medium 2 is discharged onto the discharge portion 6 formed on the apparatus body by means of discharge rollers 3*f*.

(Transfer Means)

The transfer means 4 serves to transfer the toner image formed on the photosensitive drum 7 onto the recording medium 2, and is constituted by a transfer roller as shown in FIG. 1. That is to say, the recording medium 2 is urged against the photosensitive drum 7 of the process cartridge B by the transfer roller 4, and, by applying voltage having polarity opposite to that of the toner image to the transfer roller 4, the toner image on the photosensitive drum 7 is transferred onto the recording medium 2.

(Fixing Means)

The fixing means 5 serves to fix the toner image transferred to the recording medium 2 by the transfer roller 4 to the recording medium 2. As shown in FIG. 1, the fixing means comprises a drive roller 5*a*, and a fixing roller 5*c* having a heater 5*b* therein and urged against the drive roller 5*a* to be driven. That is to say, while the recording medium 2 to which the toner image was transferred at the image forming portion is being passed between the drive roller 5*a* and the fixing roller 5*c*, the toner image is fixed to the recording medium 2 by pressure from the rollers 5*a*, 5*c* and heat from the fixing roller 5*c*.

(Process Cartridge Mounting Means)

The image forming apparatus A includes a cartridge mounting means for mounting the process cartridge B. The mounting and dismounting of the process cartridge B with respect to the apparatus body 13 is effected after an open/close cover 14 is opened. That is to say, the open/close cover 14 is pivotally mounted on an upper portion of the apparatus body 13 via a hinge 14*a*. When the cover 14 is opened, a cartridge mounting space in the apparatus body 13 is exposed. Left and right guide members (not shown) are attached to left and right side walls of the apparatus body. The left and right guide members have guides for inserting the process cartridge B, so that the process cartridge B is mounted within the image forming apparatus A by closing the open/close cover 14.

(Process Cartridge)

Next, the process cartridge B mounted to the image forming apparatus A will be explained.

The process cartridge B includes an electrophotographic photosensitive member and at least one process means. For example, the process means may be a charge means for charging a surface of the electrophotographic photosensitive member, a developing means for forming a toner image on the electrophotographic photosensitive member or/and a cleaning means for cleaning the residual toner remaining on the electrophotographic photosensitive member. As shown in FIG. 2, in the illustrated embodiment, the process cartridge B includes the charge means 8, exposure portion 9, developing means 10 and cleaning means 11 which are disposed around the photosensitive drum 7. These elements are contained within a housing comprised of a developing frame 12*a* and a cleaning frame 12*b* as a unit which can removably be mounted to the apparatus body 13.

Next, the photosensitive drum 7, charge means 8, exposure portion 9, developing means 10 and cleaning means 11 of the process cartridge B will be explained in order.

(Photosensitive Drum)

The photosensitive drum 7 is constituted by a cylindrical aluminium drum base, and an organic photosensitive layer coated on the drum base. The photosensitive drum 7 is rotatably attached to the frame. As will be described later, by transmitting a driving force of a drive motor of the image forming apparatus to a flange gear secured to one end of the photosensitive drum 7, the photosensitive drum 7 is rotated in a direction shown by the arrow in FIG. 2 in response to the image forming operation.

(Charge Means)

The charge means serves to uniformly charge the surface of the photosensitive drum 7. In the illustrated embodiment, the charge means is of a so-called contact charge type using a rotatable charge roller 8. The charge roller 8 is constituted by a metal roller shaft 8*a*, a conductive elastic layer around the roller shaft, a high resistance elastic layer around the conductive layer, and an outermost protection layer. The conductive elastic layer is formed from rubber (such as EPDM, NBR) layer including carbon dispersed therein and serves to direct bias voltage supplied to the roller shaft 8*a*. The high resistance elastic layer is formed from urethane rubber including a small amount of conductive powder, so that, even when the charge roller is opposed to a high conductivity portion (such as a pinhole) of the photosensitive drum 7, the leak current to the photosensitive drum 7 is limited, thereby preventing abrupt reduction of the bias voltage. The protection layer is from form N-methyl methoxyl nylon and serves to prevent the plastic materials of the conductive elastic layer and the high resistance elastic layer from deteriorating the surface of the photosensitive drum 7.

The charge roller 8 is contacted with the photosensitive drum 7. During the image formation, the charge roller 8 is rotatingly driven by the rotation of the photosensitive drum 7. In this case, by alternately applying DC current and AC current to the charge roller 8, the surface of the photosensitive drum 7 is uniformly charged.

(Exposure Portion)

The exposure portion 9 serves to expose the light image from the optical system 1 onto the photosensitive drum 7 uniformly charged by the charge roller 8, thereby forming the electrostatic latent image on the photosensitive drum 7 and includes an opening 9 formed in an upper surface of the cartridge frame.

(Developing Means)

As shown in FIG. 2, the developing means 10 includes the toner contained within the developing frame 12*a*, and a rotatable toner feed member 10*a* for feeding out the toner. A developing sleeve 10*c* having a non-rotatable magnet 10*b* therein and adapted to form a thin toner layer thereon is disposed within an opening of the developing frame 12*a* with a small gap with respect to the photosensitive drum 7.

The developing sleeve 10*c* includes an aluminium cylindrical member a surface of which is made rough by sandblasting treatment, and a conductive paint layer coated on the cylindrical member and having pigment dispersed therein. When the toner layer is formed on the developing sleeve 10*c*, friction charges sufficient to develop the electrostatic latent image on the photosensitive drum 7 are applied to the toner layer due to friction between the toner and the developing sleeve 10*c*. Further, there is provided a developing blade 10*d* for regulating a thickness of the toner layer.

(Cleaning Means)

As shown in FIG. 2, the cleaning means 11 comprises a cleaning blade 11*a* contacted with the photosensitive drum 7 and adapted to scrape the residual toner remaining on the photosensitive drum 7, a dip sheet 11*b* lightly contacted with the photosensitive drum 7 and disposed below the blade 11*a* to receive the scraped toner, and a waste toner reservoir 11*c* for collecting the waste toner.

(Developing Sleeve and Surrounding Area)

Next, the developing sleeve and its surrounding area will be explained with reference to FIGS. 3 and 4.

Figure 3:
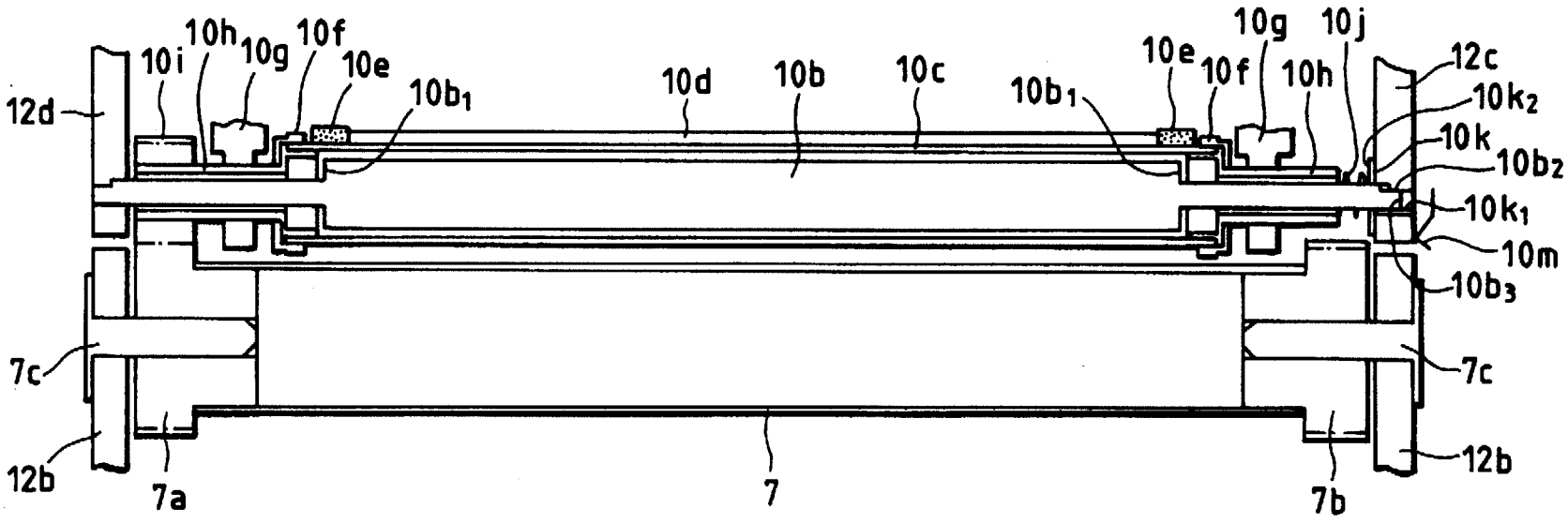
FIG. 3 is a sectional view showing a relation between a magnet roller, end seal members and an electricity supplying member, according to the first embodiment.
Figure 4:
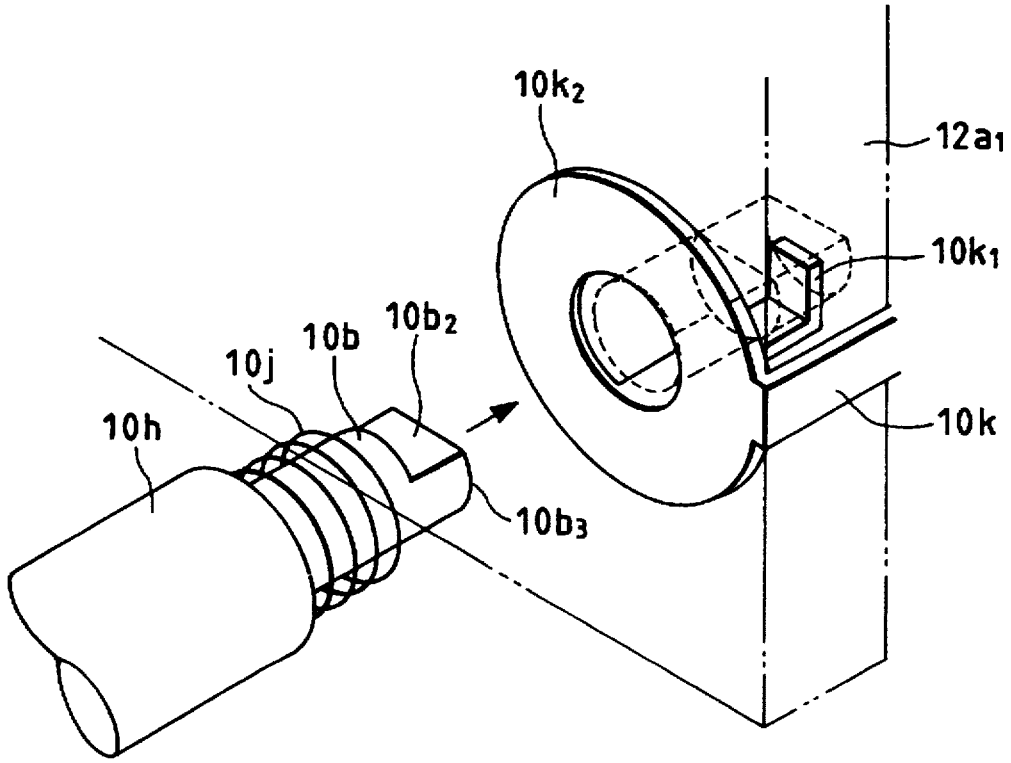
FIG. 4 is a perspective view showing a developing sleeve and an electricity supplying portion, according to the first embodiment.

As shown in FIG. 3, the developing sleeve 10*c* has flange portions 10*h* rotatably supported by bearing members 10*g* attached to the developing frame 12*a*, and an electricity supplying contact 10*j* is attached to the flange portion 10*h*. A magnet roller 10*b* is secured to side plates 12*c*, 12*d*. End seal members 10*e* for sealing the toner are disposed between the developing frame 12*a* and ends of the developing sleeve 10*c*, and an end 10*b*1 of the magnet roller 10*b* is positioned so as to overly the seal member 10*e* in a longitudinal direction.

An electricity supplying plate (electricity supplying member) 10*k* is attached to the side plate 12*c* and a portion 10k2 of the electricity supplying plate is contacted with the electricity supplying contact 10j. When the process cartridge B is mounted to the apparatus body, the electricity supplying plate 10k is contacted with an electricity supplying contact 10m of the apparatus body at an outwardly-exposed portion of the process cartridge B, thereby permitting power supply to the developing sleeve 10c. Further, the electricity supplying plate 10k is provided with a leaf spring (contact member) 10k1 as shown in FIG. 4, which leaf spring is contacted with an end 10b3 of the magnet roller 10b.

Accordingly, in the illustrated embodiment, regardless of the manufacturing accuracy of parts, positional accuracy between the magnet roller 10b and the end seal members 10e can be improved. As a result, since the toner leakage can be prevented and widths of the end seal members can be narrowed, the process cartridge B can be made compact without increasing the torque of the developing sleeve 10c.

Further, since the biasing member is formed as a part of the electricity supplying plate 10k, the number of parts is not increased, and the cost can be reduced. Unlike the conventional biasing member, since there is no need to widen a distance between the biasing member and the electricity supplying plate and/or the developing sleeve sufficient to prevent the leak, the apparatus can be prevented from becoming bulky.

Further, since the electricity supplying member is the leaf spring, even if there is unevenness in dimensions of the parts, a relatively stable biasing force can be provided, nullity of the spring portion can be prevented, and the deformation of the magnet roller can be prevented.

(Second Embodiment)

Figure 5:
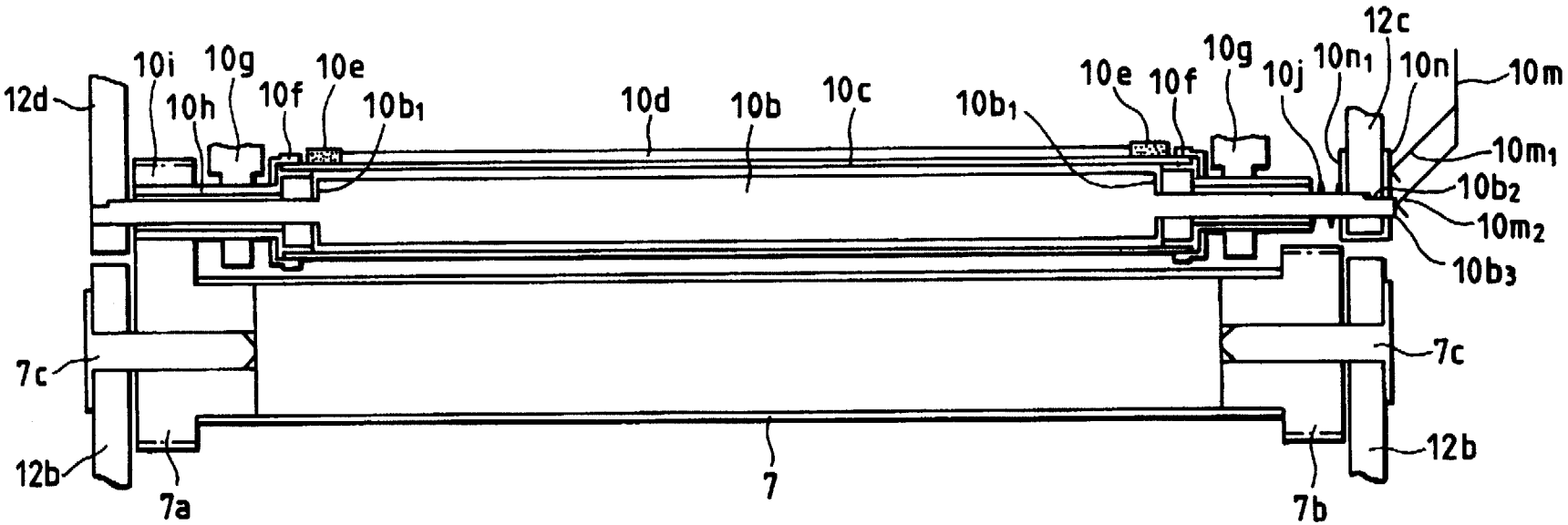
FIG. 5 is a sectional view showing a relation between a magnet roller, end seal members and an electricity supplying member, according to a second embodiment of the present invention.
Figure 6:
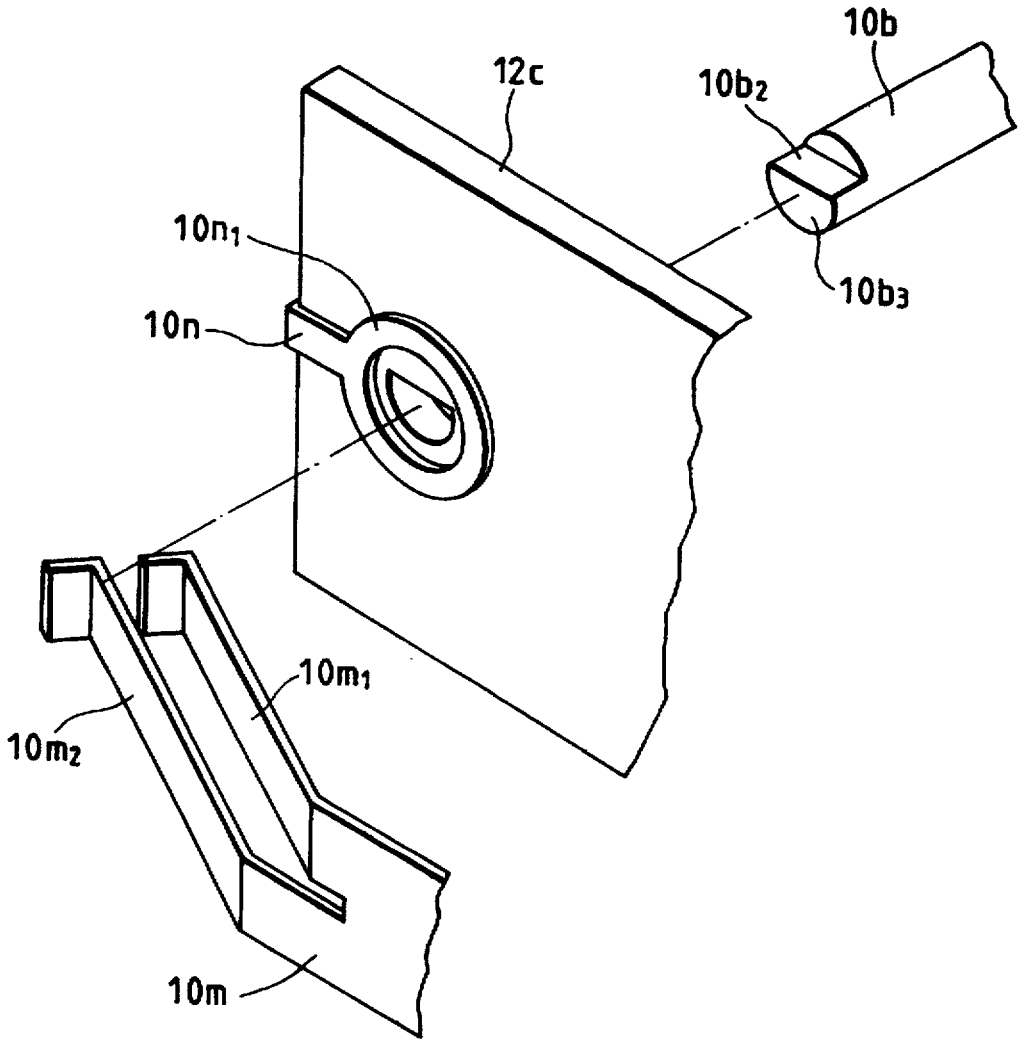
FIG. 6 is a perspective view showing a developing sleeve and an electricity supplying portion, according to the second embodiment.

Next, a second embodiment of the present invention will be explained with reference to FIGS. 5 and 6. Incidentally, elements the same as those in the first embodiment are designated by the same reference numerals and explanation thereof will be omitted.

An electricity supplying plate 10n is attached to the side plate 12c and a portion 10n1 of the electricity supplying plate is contacted with the electricity supplying contact 10j. When the process cartridge B is mounted to the apparatus body, a contact portion 10m1 of a contact member (electricity supplying member) 10m of the apparatus body is contacted with the electricity supplying plate 10n at an outwardly-exposed portion of the process cartridge B, thereby permitting the power supply to the developing sleeve 10c. Further, the contact member 10m is provided with a leaf spring 10m2 which is contacted with an end 10b3 of the magnet roller 10b. Accordingly, the same technical effect as that of the first embodiment can be obtained.

Incidentally, the electricity supplying member may be provided at a drive side of the developing sleeve (rather than the driven side), and the magnet roller may be rotated relative to the developing sleeve (not secured to the side plate).

As mentioned above, according to the illustrated embodiment, since the magnet roller is biased in the axial direction by the portion of the electricity supplying member for supplying the electricity to the developing sleeve, the positional accuracy between the magnet roller and the end seal members can be improved. As a result, since the toner leakage can be prevented and widths of the end seal members can be narrowed, the process cartridge and accordingly, the image forming apparatus can be made compact without increasing the torque of the developing sleeve. Further, since the biasing member is formed as a part of the electricity supplying member, the number of parts is not increased, and the cost can be reduced. Unlike the conventional biasing member, since there is no need to widen a distance between the biasing member and the electricity supplying member and/or the developing sleeve sufficient to prevent the leak, and the earth is not needed, the apparatus can be prevented from becoming bulky.

Further, since the magnet roller is biased in the axial direction by the electricity supplying member for supplying the electricity to the developing sleeve, by providing an electricity supplying member having a small spring constant, the stable biasing force can be obtained, without increasing the number of parts, even if there is unevenness in dimensions of the parts. That is to say, since the electricity supplying member is the leaf spring, even if there is unevenness in dimensions of the parts, a relatively stable biasing force can be provided, nullity of the spring portion can be prevented, and the deformation of the magnet roller can be prevented.

(Third Embodiment)

Next, a third embodiment of the present invention will be explained.

Figure 7:
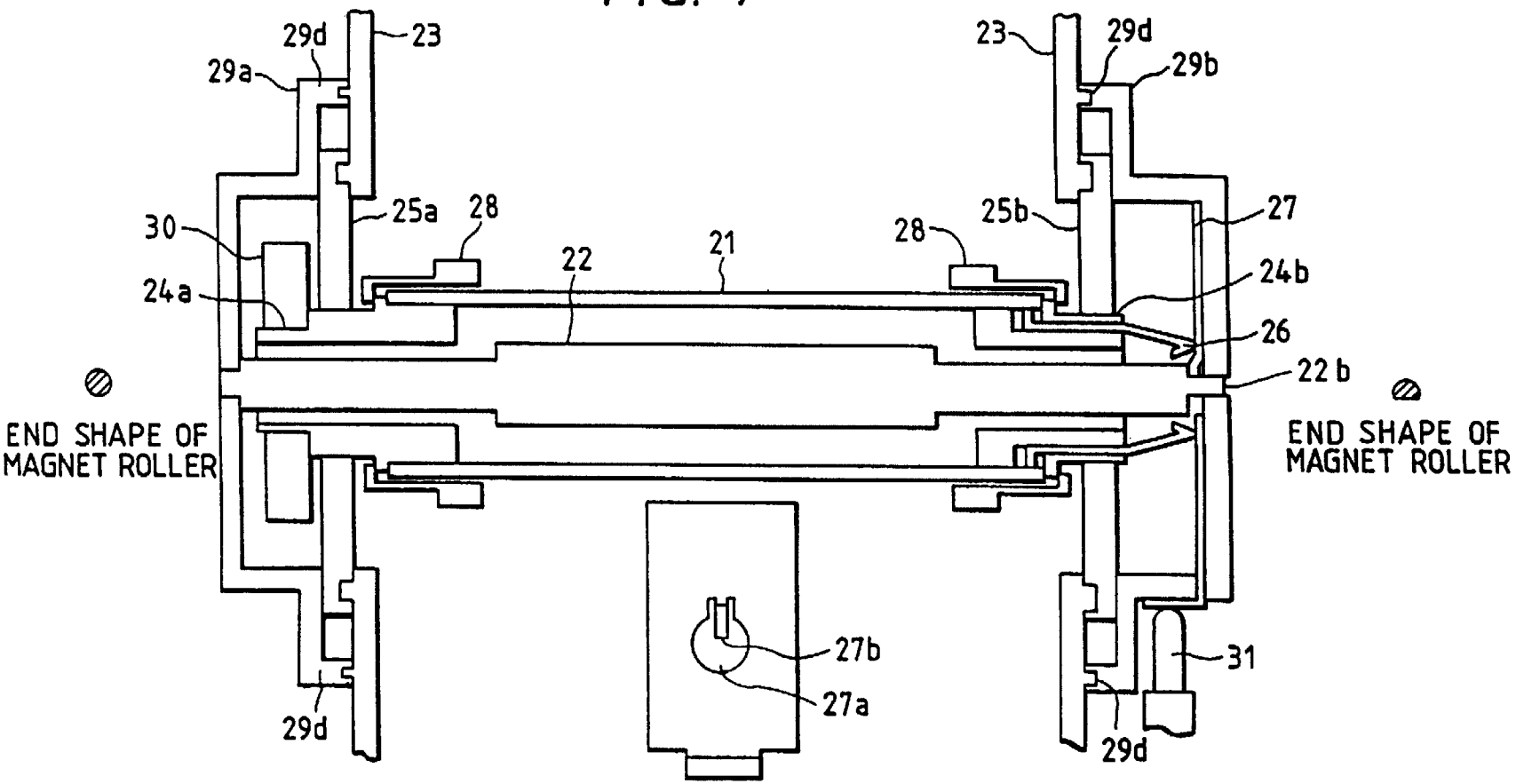
FIG. 7 is a sectional view of a developing apparatus according to a third embodiment of the present invention.

FIG. 7 is a sectional view of a developing portion provided in a process cartridge 32 removably mounted to an image forming apparatus A according to a third embodiment. A magnet roller 22 is disposed within a rotating cylindrical developing sleeve 21 made of non-magnetic metal. The magnet roller 22 is formed by injection molding with resin including magnetic powder therein.

By the magnetic force of the magnet roller 22, the developing sleeve 21 carries magnetic developing agent (one-component magnetic toner, in this embodiment). A flange 24b with a sleeve electrode 26 is secured to one end of the developing sleeve 21 by press-fit or adhesion. The flange is rotatably supported by a body 23 of the developing device via a bearing member 25b. A flange 24a is secured to the other end of the developing sleeve 21 by press-fit or adhesion, and the flange is rotatably supported by the body 23 of the developing device via a bearing member 25a. Rollers 28 contacted with a photosensitive drum (not shown) to keep a distance between the developing sleeve 21 and the photosensitive drum constant are mounted on both ends of the developing sleeve 21. A gear 30 is engaged by the flange 24a, and the developing sleeve is rotated in one direction at a predetermined speed by a driving force from a gear secured to the photosensitive drum by press-fit or adhesion.

The sleeve electrode 26 secured to the flange 24b is secured to be contacted with an inner surface of the developing sleeve 21 and is contacted with a metal electrode plate 27 secured to a holder 29b. When the process cartridge 32 is mounted to the image forming apparatus A, the electrode plate 27 is contacted with a contact 31 of the image forming apparatus to establish the electrical communication, thereby permitting the supplying of the bias voltage to the developing sleeve through the sleeve electrode 26. The magnet roller 22 disposed within the developing sleeve 21 has magnetic poles oriented at a predetermined angle with respect to the photosensitive drum. In the illustrated embodiment, the magnet roller 22 has one D-shaped protruded end 22b. The angular positioning of the magnet roller 22 is effected by fitting the D-shaped end 22b of the magnet roller 22 into a corresponding D-shaped hole formed in the holder 29b.

Regarding the positioning of the magnet roller 22 in the thrust direction, a projection 27b is protruded from a hole 27a of the electrode plate 27 secured to the holder 29b, and, by an elastic force of the projection 27b, the magnet roller 22 is urged toward the other holder 29a. With this arrangement, any play of the magnet roller in the thrust direction can be removed, with the result that the magnet roller 22 is always maintained at a constant position.

Since the magnet roller is assembled while being urged against one end, there is no need to set a clearance for absorbing the tolerance, thereby saving the space.

(Fourth Embodiment)

Next, a fourth embodiment of the present invention will be explained with reference to FIG. 8. Incidentally, the same elements as those in the third embodiment are designated by the same reference numerals and explanation thereof will be omitted.

Figure 8:
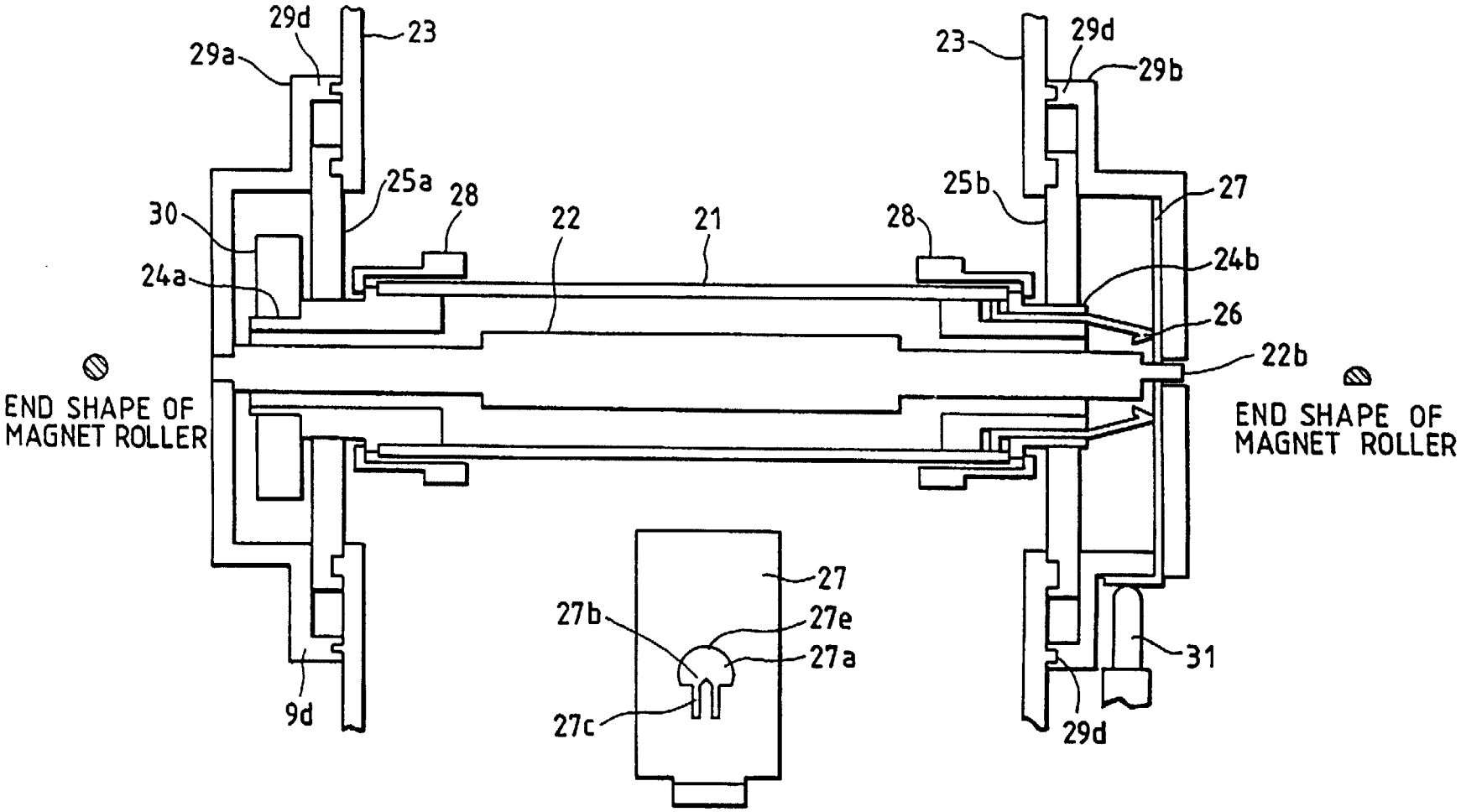
FIG. 8 is a sectional view of a developing apparatus according to a fourth embodiment of the present invention.
Figure 9:
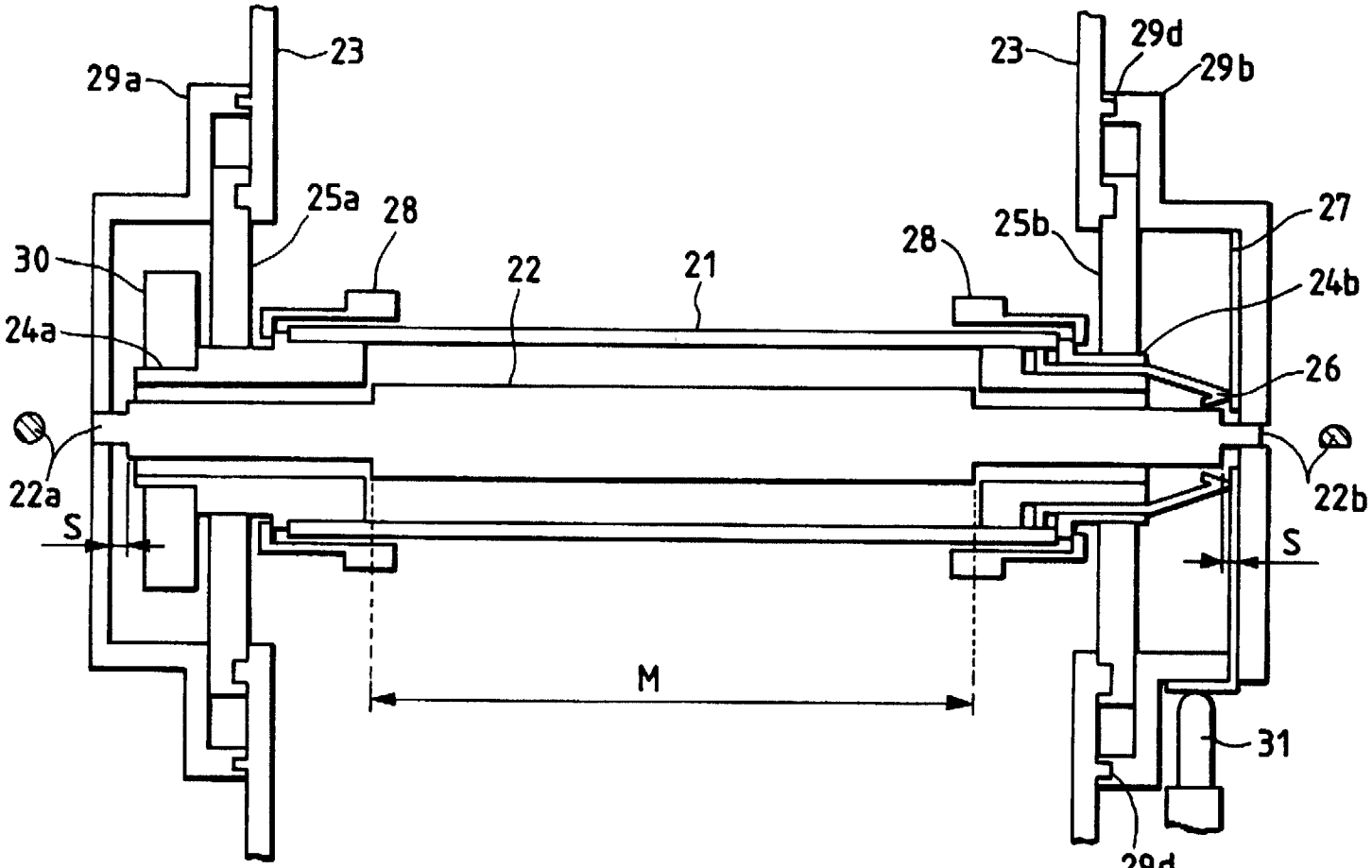
FIG. 9 is a sectional view showing an example of a developing apparatus.
Figure 10:
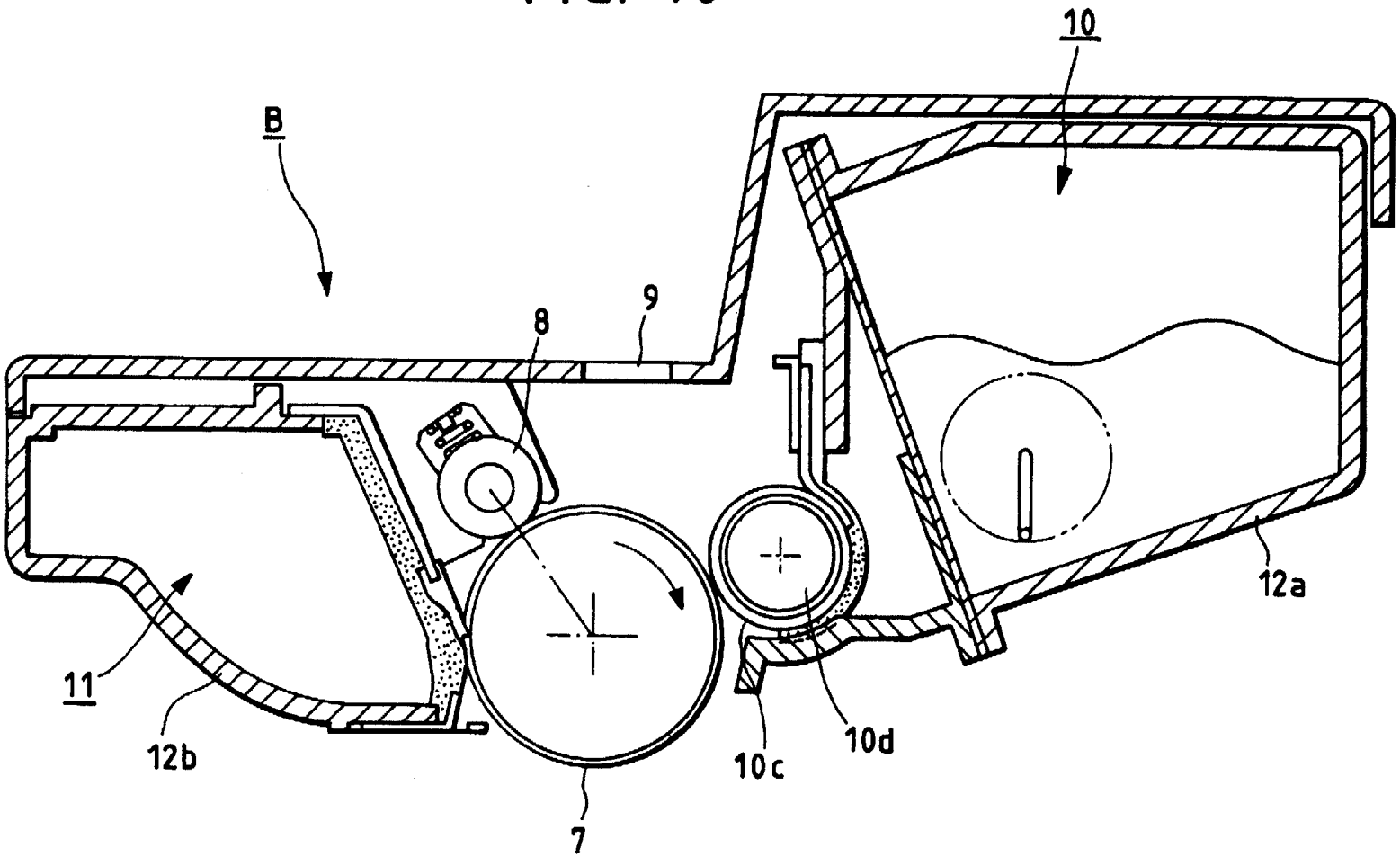
FIG. 10 is a sectional view of a conventional image forming apparatus.

In the embodiment shown in FIG. 8, the angular positioning of the magnet roller 22 is effected by the electrode plate 27. That is to say, the electrode plate 27 has a configuration which can be engaged by a peripheral surface 22*b* of the end of the magnet roller 22. A projection 27*b* is formed in a D-shaped hole 27*a* of the electrode plate 27, and the projection 27*b* has a dimension which interferes with the peripheral surface 22*b* of the end of the magnet roller.

Since slits 27*c* are provided adjacent to the projection 27*b*, when the peripheral surface 22*b* of the magnet roller is engaged by the projection, the projection 27*b* is flexed, with the result that the peripheral surface 22*b* of the magnet roller is urged against a peripheral edge 27*e* of the hole 27*a* by the elastic force of the projection 27*b*. Consequently, the magnet roller 22 is fixed with respect to the thrust direction and any play of the magnet roller is eliminated, thereby always maintaining the magnet roller 22 at the constant position.

As mentioned above, according to the illustrated embodiment, since the electrode plate 27 has the hole 27*a* through which the portion of the magnet roller 22 can pass, and the projection (pawl) 27*b* for urging the peripheral surface of the end of the magnet roller 22 against the peripheral edge 27*e* of the hole 27*a*, the magnet roller 22 can be fixed by the electrode plate 27.

Further, since the positioning of the magnet roller in the thrust direction is effected by the electrode member for supplying the electricity to the developing sleeve, the entire apparatus can be made compact, the number of parts can be reduced, and any play of the magnet roller can be eliminated.

Further, the magnet roller can be positioned in the thrust direction by the electrode member.

What is claimed is:

1. A process cartridge removably mountable to a main body of an electrophotographic image forming apparatus, said process cartridge comprising:

an electrophotographic photosensitive member;

a developing sleeve for supplying magnetic toner to said electrophotographic photosensitive member to develop a latent image formed on said electrophotographic photosensitive member;

a magnet disposed within said developing sleeve; and an electrode member, having an extended portion, for supplying electricity from the main body of the image forming apparatus to said developing sleeve when said process cartridge is mounted to the main body of the image forming apparatus;

wherein said magnet is urged by said extended portion of said electrode member so as to position said magnet in a thrust direction thereof.

2. A process cartridge according to claim 1, further comprising a thrust receiving portion for receiving one end of said magnet, which is a roll-shaped magnet, wherein said extended portion of said electrode member has an urging member for urging the other end of said roll-shaped magnet against said thrust receiving portion.

3. A process cartridge according to claim 2, wherein said extended portion of said electrode member has a spring feature, wherein said electrode member has a hole through which the other end of said roll-shaped magnet can pass, and wherein said extended portion of said electrode member urges the other end of said roll-shaped magnet, which is passed through said hole, toward the thrust direction.

4. A process cartridge according to claim 3, wherein said electrode member is attached to a frame of the process cartridge, and, when the process cartridge is mounted to the main body of said image forming apparatus, a portion of the process cartridge exposed out of said frame is contacted with an electricity supplying contact provided on the main body of said image forming apparatus, thereby supplying electricity to said developing sleeve.

5. A process cartridge according to claim 4, wherein the other end of said roll-shaped magnet has a D-shaped configuration, and said electrode member supplies electricity through an electricity supplying contact attached to the other end of said roll-shaped magnet.

6. A process cartridge according to claim 1, wherein said magnet is roll-shaped, wherein said electrode member has a hole through which one end of said roll-shaped magnet can pass, and said extended portion of said electrode member urges a longitudinal surface of the one end of said roll-shaped magnet so that the one end of said roll-shaped magnet is urged against an inner peripheral edge of said hole.

7. A process cartridge according to claim 6, wherein said extended portion of said electrode member is a pawl, and the movement of said roll-type magnet in the thrust direction thereof is regulated by urging the one end of said roll-type magnet against the inner peripheral edge of said hole by an elastic force of said pawl.

8. A process cartridge according to claim 5 or 7, wherein said roll-type magnet is a plastic magnet having a roller shape and is made of resin including a magnetic component.

9. A process cartridge according to claim 5 or 7, further comprising a charge member for charging said electrophotographic photosensitive member.

10. A process cartridge according to claim 9, further comprising a cleaning member for removing the magnetic toner remaining on said electrophotographic photosensitive member.

11. An image forming apparatus to which a process cartridge can be removably mounted, said image forming apparatus comprising:

(a) a mounting portion for removably mounting a process cartridge including an electrophotographic photosensitive member, a developing sleeve for supplying magnetic toner to said electrophotographic photosensitive member to develop a latent image formed on said electrophotographic photosensitive member, a magnet disposed within said developing sleeve, and an electrode member, having an extended portion, for supplying electricity from a main body of said image forming apparatus to said developing sleeve when said process cartridge is mounted to the main body of said image forming apparatus, wherein said magnet is urged by said extended portion of said electrode member so as to position said magnet in a thrust direction thereof; and (b) an electricity supplying contact contacted with said electrode member to supply electricity to said developing sleeve when said process cartridge is mounted to the main body of said image forming apparatus.

12. A developing apparatus for developing a latent image formed on an electrophotographic photosensitive member, said developing apparatus comprising:

a developing sleeve for supplying magnetic toner to said electrophotographic photosensitive member to develop a latent image formed on said electrophotographic photosensitive member;

a magnet disposed within said developing sleeve; and an electrode member, having an extended portion, for supplying electricity from a main body of an image forming apparatus to said developing sleeve when a process cartridge having said developing apparatus is mounted to the main body of said image forming apparatus, wherein said magnet is urged by said extended portion of said electrode member so as to position said magnet in a thrust direction thereof.

13. A developing apparatus according to claim 12, further comprising a thrust receiving portion for receiving one end of said magnet, which is a roll-shaped magnet, wherein said extended portion of said electrode member has an urging member for urging the other end of said roll-shaped magnet against said thrust receiving portion.

14. A developing apparatus according to claim 13, wherein said extended portion of said electrode member has a spring feature, wherein said electrode member has a hole through which the other end of said roll-shaped magnet can pass, and wherein said extended portion of said electrode member urges the other end of said roll-shaped magnet which is passed through said hole, toward the thrust direction.

15. A developing apparatus according to claim 14, wherein said electrode member is attached to a frame, and, when the developing apparatus is mounted to the main body of said image forming apparatus, an exposed portion of said frame is contacted with an electricity supplying contact of the main body of said image forming apparatus, thereby supplying electricity to said developing sleeve.

16. A developing apparatus according to claim 15, wherein the other end of said roll-shaped magnet has a D-shaped configuration, and said electrode member supplies electricity through an electricity supplying contact attached to the other end of said roll-shaped magnet.

17. A developing apparatus according to claim 12, wherein said magnet is roll-shaped, wherein said electrode member has a hole through which one end of said roll-shaped magnet can pass, and said extended portion of said electrode member urges a longitudinal surface of the one end of said roll-shaped magnet so that the one end of said roll-shaped magnet is urged against an inner peripheral edge of said hole.

18. A developing apparatus according to claim 17, wherein said extended portion of said electrode member is a pawl, and the movement of said roll-type magnet in the thrust direction thereof is regulated by urging the one end of said roll-type magnet against the inner peripheral edge of said hole by an elastic force of said pawl.

19. A developing apparatus according to claim 16 or 18, wherein said roll-type magnet is a plastic magnet having a roller shape and is made of resin including a magnetic component.

20. An electrode member used with a process cartridge, removably mountable to an image forming apparatus, including an electrophotographic photosensitive member, a developing sleeve for supplying magnetic toner to said electrophotographic photosensitive member to develop a latent image formed on said electrophotographic photosensitive member, and a magnet disposed within said developing sleeve, said electrode member being adapted to supply electricity from a main body of said image forming apparatus to said developing sleeve when said process cartridge is mounted to the main body of said image forming apparatus, said electrode member comprising:

an extended portion for urging said magnet in a thrust direction thereof so as to position said magnet.

21. An electrode member according to claim 20, wherein said extended portion has a positioning portion for positioning one end of said magnet, which is a roll-shaped magnet, in the thrust direction thereof.

22. An electrode member according to claim 21, wherein said extended portion of said electrode member has a spring feature, wherein said electrode member has a hole through which the other end of said roll-shaped magnet can pass, and wherein said extended portion of said electrode member urges the one end of said roll-shaped magnet, which is passed through said hole, toward the thrust direction.

23. An electrode member according to claim 22, wherein said electrode member is attached to a frame of said process cartridge, and, when said process cartridge is mounted to the main body of said image forming apparatus, a portion of said process cartridge exposed out of said frame is contacted with an electricity supplying contact provided on the main body of said image forming apparatus, thereby supplying electricity to said developing sleeve.

24. An electrode member according to claim 23, wherein the one end of said roll-shaped magnet has a D-shaped configuration, and the electrode member supplies electricity through an electricity supplying contact attached to the one end of said roll-shaped magnet.

25. An electrode member according to claim 20, wherein said magnet is roll-shaped, wherein said electrode member has a hole through which one end of said roll-shaped magnet can pass, and said extended portion of said electrode member urges a longitudinal surface of the one end of said roll-shaped magnet so that the one end of said roll-shaped magnet is urged against an inner peripheral edge of said hole.

26. An electrode member according to claim 25, wherein said extended portion of said electrode member is a pawl, and the movement of said roll-type magnet in the thrust direction thereof is regulated by urging the one end of said roll-type magnet against the inner peripheral edge of said hole by an elastic force of said pawl.

27. A process cartridge removably mountable to a main body of an electrophotographic image forming apparatus, said process cartridge comprising:

an electrophotographic photosensitive member;

a developing sleeve for supplying magnetic toner to said electrophotographic photosensitive member to develop a latent image formed on said electrophotographic photosensitive member;

a magnet disposed within said developing sleeve; and an electrode member for supplying electricity from the main body of the image forming apparatus to said developing sleeve when the process cartridge is mounted to the main body of the image forming apparatus, wherein said electrode member has a hole through which one end of said magnet can pass, and a portion of said electrode member urges a longitudinal surface of the one end of said magnet so that the one end of said magnet is urged against an inner peripheral edge of said hole, and wherein said magnet is positioned in a thrust direction thereof by said electrode member.

28. A process cartridge according to claim 27, wherein said portion of said electrode member is a pawl, and movement of said magnet in the thrust direction thereof is regulated by urging the one end of said magnet against the inner peripheral edge of said hole by an elastic force of said pawl.

29. A process cartridge according to claim 28, wherein said magnet is a plastic magnet having a roller shape and is made of resin including a magnetic component.

30. A process cartridge according to claim 28 or 29, further comprising a charge member for charging said electrophotographic photosensitive member.

31. A process cartridge according to claim 30, further comprising a cleaning member for removing the magnetic toner remaining on said electrophotographic photosensitive member.

32. A developing apparatus for developing a latent image formed on an electrophotographic photosensitive member in a process cartridge removably mountable in a main body of an image forming apparatus, said developing apparatus comprising:

a developing sleeve for supplying magnetic toner to the electrophotographic photosensitive member to develop a latent image formed on the electrophotographic photosensitive member;

a magnet disposed within said developing sleeve; and an electrode member for supplying electricity from the main body of the image forming apparatus to said developing sleeve when the process cartridge is mounted to the main body of the image forming apparatus, wherein said electrode member has a hole through which one end of said magnet can pass, and a portion of said electrode member urges a longitudinal surface of the one end of said magnet so that the one end of said magnet is urged against an inner peripheral edge of said hole, and wherein said magnet is positioned in a thrust direction thereof by said electrode member.

33. A developing apparatus according to claim 32, wherein said portion of said electrode member is a pawl, and movement of said magnet in the thrust direction thereof is regulated by urging the one end of said magnet against the inner peripheral edge of said hole by an elastic force of said pawl.

34. A developing apparatus according to claim 33, wherein said magnet is a plastic magnet having a roller shape and made of resin including a magnetic component.

35. An electrode member used with a process cartridge including an electrophotographic photosensitive member, a developing sleeve for supplying magnetic toner to said electrophotographic photosensitive member to develop a latent image formed on said electrophotographic photosensitive member, and a magnet disposed within said developing sleeve, said electrode member being adapted to supply electricity from a main body of an image forming apparatus to said developing sleeve when said process cartridge is mounted to the main body of the image forming apparatus, said electrode member comprising:

a positioning portion for positioning said magnet in a thrust direction thereof, wherein said electrode member has a hole through which one end of said magnet can pass, and a portion of said electrode member urges a longitudinal surface of the one end of said magnet so that the one end of said magnet is urged against an inner peripheral edge of said hole.

36. An electrode member according to claim 35, wherein said portion of the electrode member is a pawl, and the movement of said magnet in the thrust direction thereof is regulated by urging the one end of said magnet against the inner peripheral edge of said hole by an elastic force of said pawl.

* * * * *

UNITED STATES PATENT AND TRADEMARK OFFICE

CERTIFICATE OF CORRECTION

PATENT NO. : 5,768,658

DATED : June 16, 1998

INVENTOR(S) : KAZUSHI WATANABE ET AL.

It is certified that error appears in the above-identified patent and that said Letters Patent is hereby corrected as shown below:

COLUMN 6

Line 9, "is from form" should read --is formed from--.

Line 64, "overly" should read --overlap--.

COLUMN 10

Line 20, "one" should read --a biased--.

Line 22, "one" should read --biased--.

Line 23, "one" should read --biased--.

Line 28, "one" should read --biased--.

COLUMN 11

Line 40, "one" should read --the biased--.

Line 42, "one" should read --biased--.

Line 43, "one" should read --biased--.

Line 49, "one" should read --biased--.

UNITED STATES PATENT AND TRADEMARK OFFICE

CERTIFICATE OF CORRECTION

PATENT NO. : 5,768,658

DATED : June 16, 1998

INVENTOR(S) : KAZUSHI WATANABE ET AL.

It is certified that error appears in the above-identified patent and that said Letters Patent is hereby corrected as shown below:

COLUMN 12

Line 9, "other" should read --one--.

Signed and Sealed this

Twenty-second Day of June, 1999

*Attest:*

Q. TODD DICKINSON

*Attesting Officer*

*Acting Commissioner of Patents and Trademarks*